US005785802A

United States Patent [19]

Seki et al.

[11] Patent Number: 5,785,802

[45] Date of Patent: Jul. 28, 1998

[54] METHOD AND APPARATUS FOR SINGLE FACER GLUE APPLICATION ADJUSTMENT

[75] Inventors: Yukuharu Seki; Makoto Ando; Toshiaki Miura, all of Mihara, Japan

[73] Assignee: Mitsubishi Jukogyo Kabushiki Kaisha, Tokyo, Japan

[21] Appl. No.: 613,172

[22] Filed: Mar. 8, 1996

[30] Foreign Application Priority Data

Mar. 29, 1995 [JP] Japan ..... 7-071671

[51] Int. Cl.[6] ..... B65H 23/188; B65H 37/04

[52] U.S. Cl. ..... 156/471; 73/507; 156/361

[58] Field of Search ..... 156/471, 578, 156/574, 361; 73/507, 529

[56] References Cited

U.S. PATENT DOCUMENTS

| | | | |
|---|---|---|---|
| 3,046,935 | 7/1962 | Wilson | 118/674 |
| 3,520,276 | 7/1970 | Martin | 118/674 |
| 3,521,551 | 7/1970 | Boxmeyer | 118/674 X |
| 4,259,918 | 4/1981 | Ward et al. | 73/529 X |
| 4,569,864 | 2/1986 | McIntyre | 118/674 X |
| 4,620,896 | 11/1986 | Sueki et al. | 156/471 |
| 5,037,665 | 8/1991 | LaMantia et al. | 427/8 |
| 5,415,720 | 5/1995 | Schönhammer et al. | 156/357 |
| 5,584,932 | 12/1996 | Clark et al. | 118/674 X |

FOREIGN PATENT DOCUMENTS

| | | |
|---|---|---|
| 0601528 | 6/1994 | European Pat. Off. . |
| 1138683 | 1/1969 | United Kingdom . |
| 1145533 | 3/1969 | United Kingdom . |
| 2095430 | 9/1982 | United Kingdom . |
| 2235142 | 2/1991 | United Kingdom . |

*Primary Examiner*—Francis J. Lorin

*Attorney, Agent, or Firm*—Rothwell, Figg, Ernst & Kurz

[57] ABSTRACT

To provide a single facer glue application adjusting method and apparatus which enable ① to prevent occurrence of defective sheet accompanying with operation mistake like negligence of setting change of roll gap in a change of papers, ② to improve appearance of corrugated board sheet and to enhance quality of strength etc. of same and ③ to decrease manufacturing cost of a glue application adjusting apparatus. A glue application roll 1 rotating at a circumferential velocity $v_1$ different from that $v_2$ of a downstream side corrugating roll (an upper corrugating roll) 9 is moved to touch the downstream side corrugating roll 9 via a core paper 11 and, upon variation in the circumferential velocity of each said roll caused thereby, a setting position of the glue application roll 1 to the downstream side corrugating roll 9 is adjusted, thus a gap between the glue application roll 1 and the downstream side corrugating roll 9 is maintained approximately at a thickness of the core paper 11.

7 Claims, 4 Drawing Sheets

METHOD AND APPARATUS FOR SINGLE FACER GLUE APPLICATION ADJUSTMENT

BACKGROUND OF THE INVENTION

1. Field of the Invention

The present invention relates to a method and an apparatus for a single facer glue application adjustment in which a glue application roll is adjusted of its setting position to a downstream side corrugating roll to corrugate a core paper in engagement with an upstream side corrugating roll.

2. Description of the Prior Art

A belt pressing type single facer in the prior art is described with reference to FIG. 2. Numeral 1 designates a glue application roll, numeral 3 designates a doctor roll, numeral 4 designates a glue tank forming a wall on one side by the glue application roll 1 and the doctor roll 3, numeral 2 designates a glue within the glue tank 4, numeral 7 designates a glue application portion unit supporting the glue application roll 1, the doctor roll 3 and the glue tank 4, numeral 9 designates a downstream side corrugating roll (an upper corrugating roll), numeral 12 designates an upstream side corrugating roll (a lower corrugating roll) contra-rotating in engagement with the downstream side corrugating roll 9, numeral 11 designates a core paper, numeral 15 designates an endless belt pressing touchingly the downstream side corrugating roll 9, numeral 13 designates a single faced corrugated board sheet, numeral 14 designates a liner, thus a glue application apparatus of a belt pressing type single facer is constructed by the glue application roll 1, the doctor roll 3 and the glue tank 4.

In the belt pressing type single facer in the prior art shown in FIG. 2, the core paper 11 is led between the upstream side corrugating roll 12 and the downstream side corrugating roll 9 engaging and contra-rotating each other to be corrugated into a wave-shaped state and then this core paper 11 is led between the glue application roll 1 and the downstream side corrugating roll 9.

Then, in the glue application apparatus, the glue 2 within the glue tank 4 is applied to the outer circumferential surface of the rotating glue application roll 1, is adjusted to form a glue film of a predetermined thickness by the doctor roll 3, is transferred rotatingly to the direction of the downstream side corrugating roll 9 and is coated on the tip portions of corrugations of the core paper 11.

Said core paper 11 and the liner 14 supplied via another route are led between the endless belt 15 and the downstream side corrugating roll 9 to be lapped each other and, with a predetermined pressing force P and temperature, the core paper 11 and the liner 14 are bonded by the glue 2 coated on the tip portions of corrugations of the core paper 11, thus the single faced corrugated board sheet 13 is produced.

FIG. 3 shows an example of a gap adjusting apparatus in the prior art for adjusting a gap between the downstream side corrugating roll 9 and the glue application roll 1. Numeral 16 designates a frame, numeral 17 designates a cylinder mounted on the frame 16 and a piston rod of the cylinder 17 is supported pivotally by the glue application portion unit 7.

Numeral 18 designates a positioning metal element fixed to the glue application portion unit 7, numeral 20 designates an eccentric shaft and numeral 19 designates a stopper supported by the eccentric shaft 20.

In the gap adjusting apparatus shown in FIG. 3 for adjusting the gap between the downstream side corrugating roll 9 and the glue application roll 1, the cylinder 17 is moved to the direction of elongation, the positioning metal element 18 is hit to the stopper 19, thus the gap between the downstream side corrugating roll 9 and the glue application roll 1 is set to a predetermined measure.

If the gap between the downstream side corrugating roll 9 and the glue application roll 1 is to be adjusted in the above-mentioned state, the eccentric shaft 20 is rotated, the stopper 19 is moved to the right or left in the figure, the positioning metal element 18 and the glue application portion unit 7 are moved in same direction and the gap between the downstream side corrugating roll 9 and the glue application roll 1 is finely adjusted.

Incidentally, as a roll gap adjusting apparatus not shown in the figure, there is one in which an insertion amount of a wedge-like element inserted between the stopper 19 and the positioning metal element 18 is changed, a stopping position of the glue application portion unit 7 is changed, thereby a gap between the downstream side corrugating roll 9 and the glue application roll 1 is adjusted.

FIG. 4 shows another example of a gap adjusting apparatus in the prior art for adjusting a gap between the downstream side corrugating roll 9 and the glue application roll 1. This roll gap adjusting apparatus is constructed so that the glue application portion unit 7 supporting the glue application roll 1, the doctor roll 3 and the glue tank 4 is moved up and down by a cylinder 21, thereby the glue application roll 1 and the downstream side corrugating roll 9 can make contact or separate from each other, and at the stroke end position of the cylinder 21, the gap between the glue application roll 1 and the downstream side corrugating roll 9 is set at a predetermined measure corresponding to a thickness of the core paper 11.

The gap adjusting apparatus in the prior art shown in FIG. 3 is constructed so that the cylinder 17 is moved to the direction of elongation, the positioning metal element 18 is hit to the stopper 19, thus the gap between the downstream side corrugating roll 9 and the glue application roll 1 is set to a predetermined measure.

Further, the gap adjusting apparatus in the prior art shown in FIG. 4 is constructed so that the glue application portion unit 7 supporting the glue application roll 1, the doctor roll 3 and the glue tank 4 is moved up and down by the cylinder 21, thereby the glue application roll 1 and the downstream side corrugating roll 9 can make contact or separate from each other, and at the stroke end position of the cylinder 21, the gap between the glue application roll 1 and the downstream side corrugating roll 9 is set at a predetermined measure corresponding to the thickness of the core paper 11.

Accordingly, in order to make a condition of glue transfer uniform in a case of change of thickness of a core paper accompanying with change of orders (change of papers), it becomes necessary to adjust the gap between the downstream side corrugating roll 9 and the glue application roll 1 to a predetermined measure. A change of orders is generally made during operation of machines and it is necessary to make the roll gap adjustment manually during operation at each time of change of orders, and moreover as the adjustment is troublesome and a long time is needed for re-setting, there is such a problem that an operation efficiency of a single facer is lowered.

Further, there are such shortcomings that due to negligence or failure of said re-setting, for example, in case of a changed core paper 11 being thicker than the roll gap, a pressing force acts on the core paper 11 so that the core paper 11 tears, or in case of a changed core paper 11 being thinner than the roll gap, the gap between the core paper 11 and the glue application roll 1 increases so that a glue transfer amount becomes less.

Thickness of a core paper 11 differs according to the kind of paper or a temperature condition etc. in the vicinity of a single facer. A method of making a roll gap adjustment by use of actually measured value of paper thickness requires actual measuring of paper thickness at each time of change of orders, which work is troublesome, and a method of obtaining a roll gap by calculations requires troublesome calculations to make corrections of changes of length of each component or part due to thermal expansion as the single facer uses saturated steam, thus there are problems both in these methods.

SUMMARY OF THE INVENTION

In view of the above-described problems in the prior art, it is an object of the present invention to provide a method and an apparatus for a single facer glue application adjustment by which ① occurrence of defective sheet accompanying with operation mistake like negligence of setting change etc. can be prevented, ② appearance of corrugated board sheet to be produced is improved and quality of strength etc. can be enhanced and ③ manufacturing cost of a glue application adjusting apparatus can be lowered.

In order to attain the above-mentioned objects, one feature of a single facer glue application adjusting method according to the present invention is that a glue application roll is rotated at a circumferential velocity different from that of a downstream side corrugating roll; said glue application roll is moved toward the downstream side corrugating roll to touch the downstream side corrugating roll via a core paper; and when the circumferential velocity of the glue application roll varies, movement of said glue application roll is stopped so that a gap between the glue application roll and the downstream side corrugating roll is adjusted approximately to a thickness of the core paper (claim 1).

Another feature of a single facer glue application adjusting method according to the present invention is that a glue application roll is rotated at a circumferential velocity different from that of a downstream side corrugating roll; said glue application roll is moved toward the downstream side corrugating roll to touch the downstream side corrugating roll via a core paper; and when the circumferential velocity of the glue application roll coincides with that of the downstream side corrugating roll, movement of said glue application roll is stopped so that a gap between the glue application roll and the downstream side corrugating roll is adjusted approximately to a thickness of the core paper.

Still another feature of a single facer glue application adjusting method according to the present invention is that a glue application roll is rotated at a circumferential velocity different from that of a downstream side corrugating roll; said glue application roll is moved toward the downstream side corrugating roll to touch the downstream side corrugating roll via a core paper; after the circumferential velocity of the glue application roll coincides with that of the downstream side corrugating roll, said glue application roll is moved to the direction of separation from the downstream side corrugating roll; and when the circumferential velocity of the glue application roll comes to an initially determined velocity, movement of said glue application roll is stopped so that a gap between the glue application roll and the downstream side corrugating roll is adjusted approximately to a thickness of the core paper.

Further, a feature of a single facer glue application adjusting apparatus according to the present invention is that it comprises a moving device to move a glue application roll touchably to or separably from a downstream side corrugating roll, a detection device to detect a circumferential velocity of the glue application roll, a detection device to detect a circumferential velocity of the downstream side corrugating roll and a control device to receive signals of said both detection devices and to control work of said moving device based on said signals and is so constructed that a gap between the glue application roll and the downstream side corrugating roll is adjusted approximately to a thickness of a core paper upon variation in the circumferential velocity of the glue application roll.

As a single facer glue application adjusting method and apparatus according to the present invention is constructed as mentioned above, a glue application roll rotating at a circumferential velocity different from that of a downstream side corrugating roll is moved to touch the downstream side corrugating roll via a core paper and, upon variation in the circumferential velocity of each said roll caused thereby, a gap between the glue application roll and the downstream side corrugating roll can be maintained approximately at a thickness of the core paper.

DESCRIPTION OF THE PREFERRED EMBODIMENTS

Figure 1:
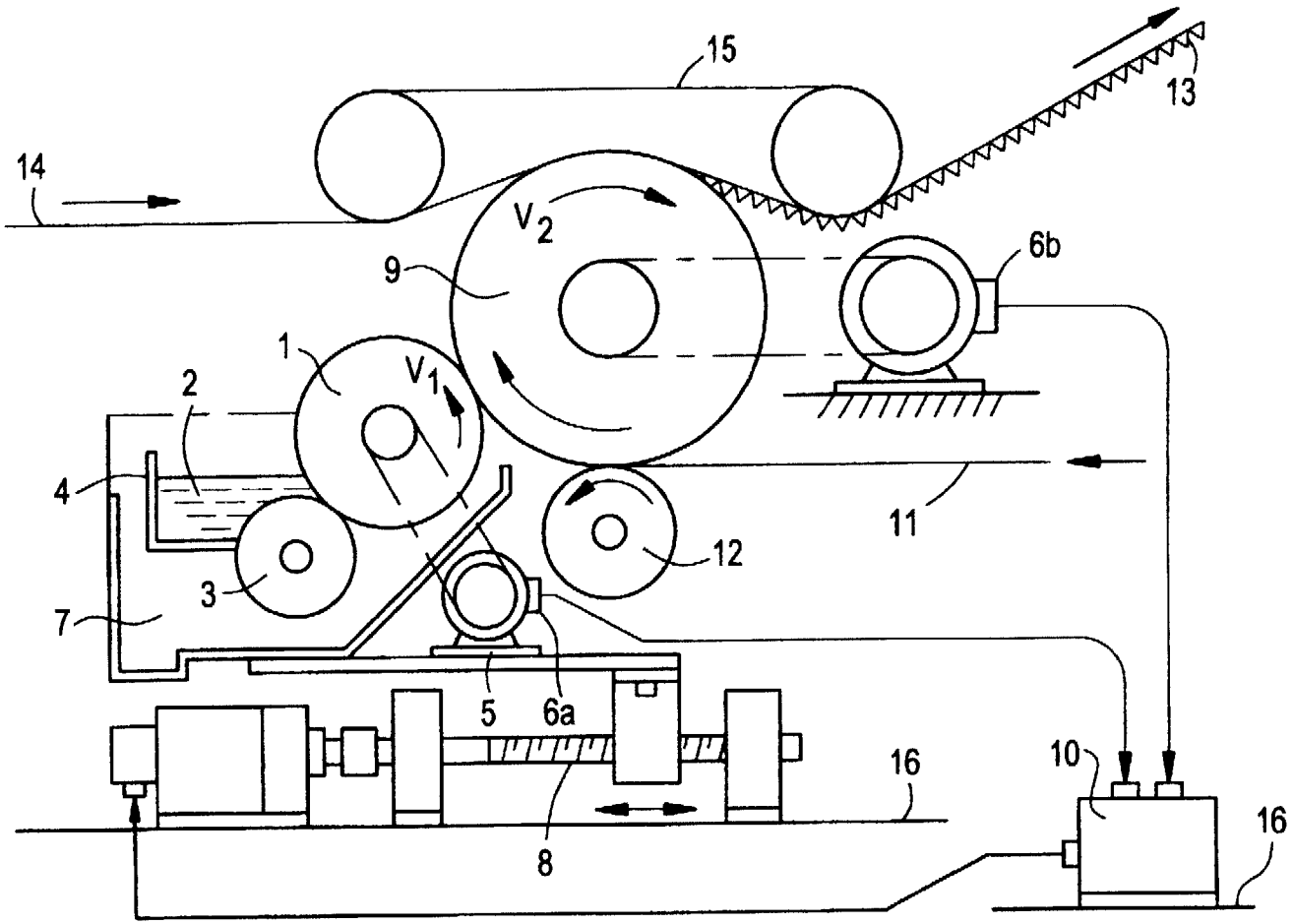
FIG. 1 is a side view showing an example of a construction of a glue application adjusting apparatus applied to working of a single facer glue application adjusting method according to the present invention.
Figure 2:
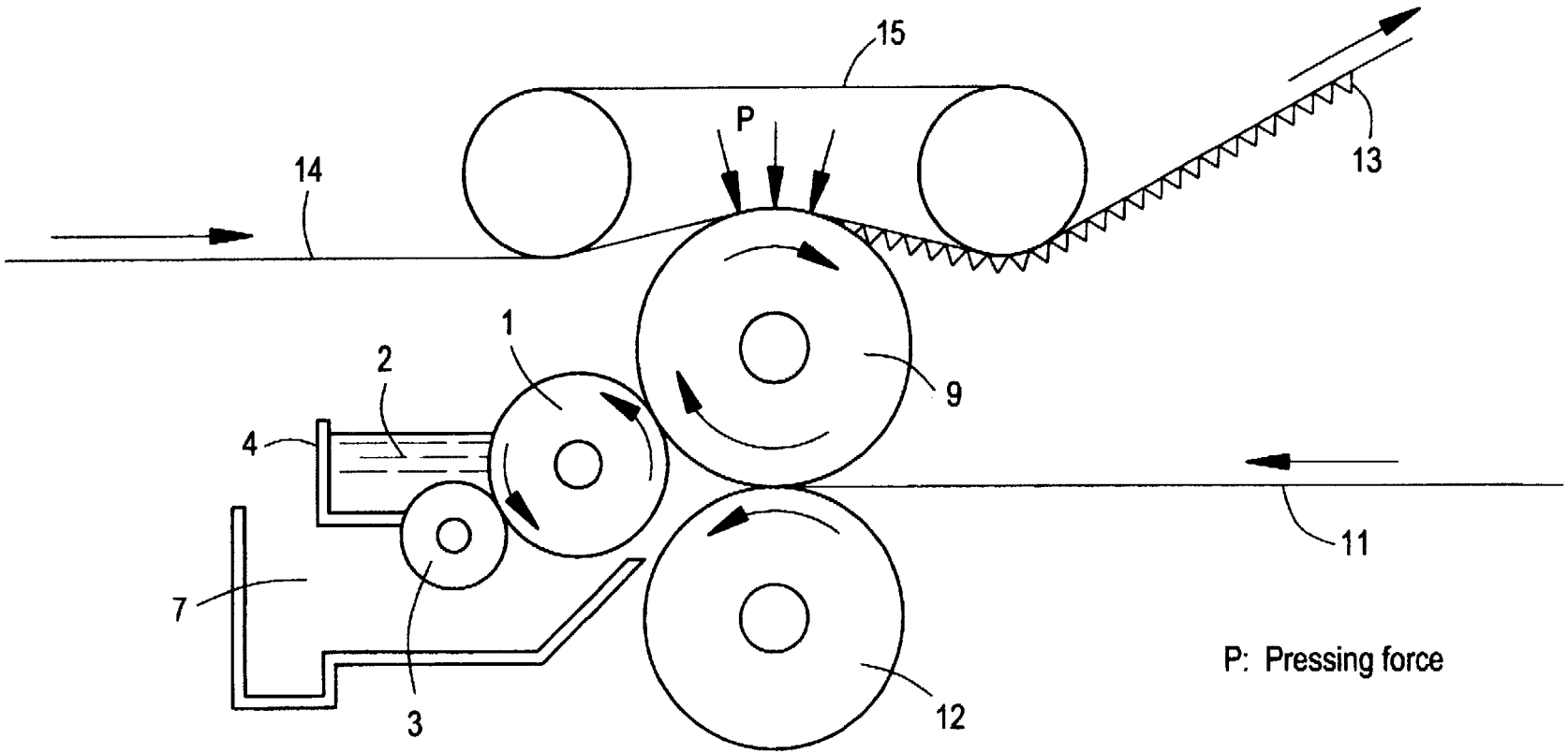
FIG. 2 PRIOR ART
FIG. 2 is a side view showing an example of a belt pressing type single facer in the prior art.
Figure 3:
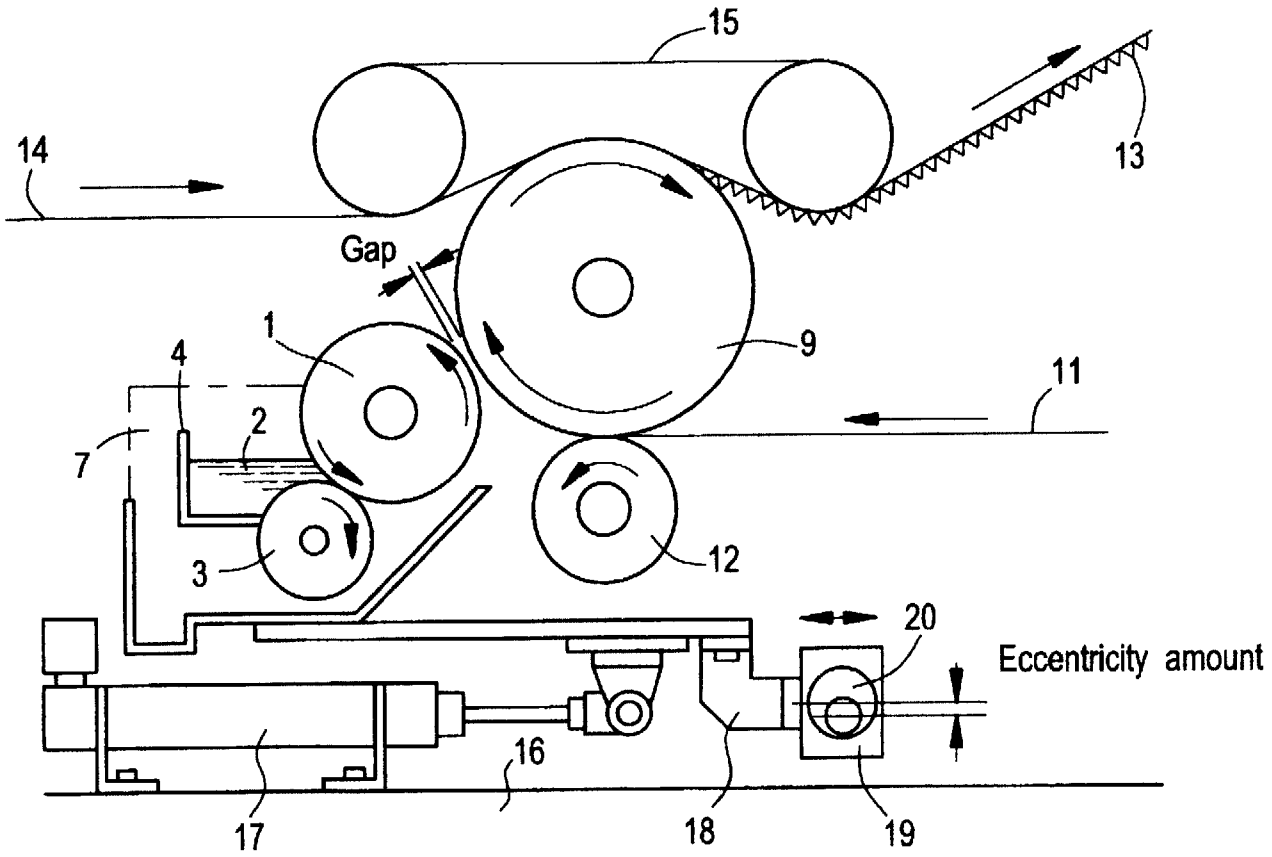
FIG.3 PRIOR ART
FIG. 3 is a side view showing an example of a roll gap adjusting apparatus in the prior art.
Figure 4:
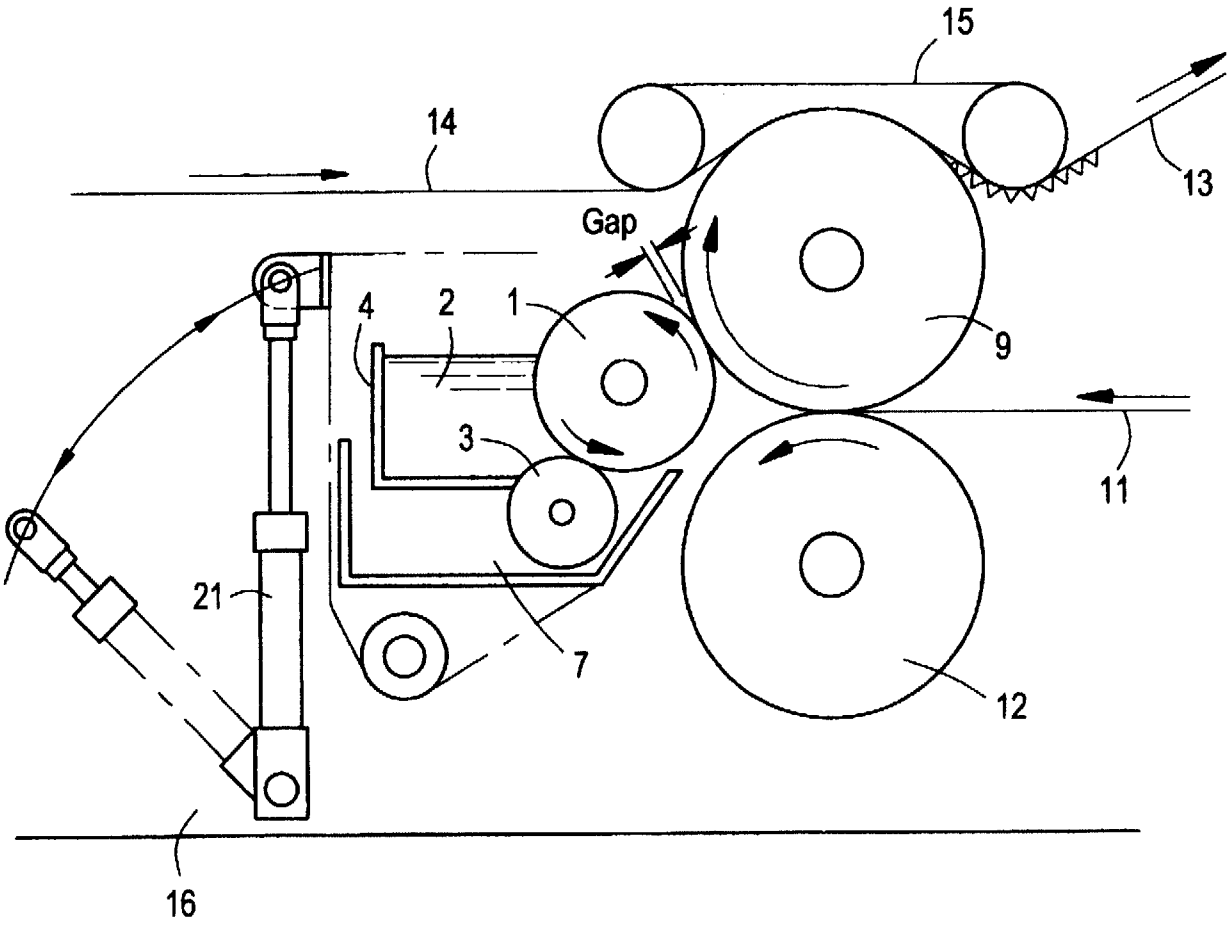
FIG. 4 PRIOR ART
FIG. 4 is a side view showing another example of a roll gap adjusting apparatus in the prior art.

Description is made with reference to FIG. 1 on an example of a construction of a glue application adjusting apparatus applied to working of a single facer glue application adjusting method according to the present invention. Numeral 1 designates a glue application roll, numeral 3 designates a doctor roll, numeral 4 designates a glue tank forming a wall on one side by the glue application roll 1 and the doctor roll 3, numeral 2 designates a glue within the glue tank 4, numeral 7 designates a glue application portion unit supporting the glue application roll 1, the doctor roll 3 and the glue tank 4, numeral 9 designates a downstream side corrugating roll (an upper corrugating roll), numeral 6*b* designates a detection device of a circumferential velocity $v_2$ of the downstream side corrugating roll 9, numeral 12 designates an upstream side corrugating roll (a lower corrugating roll) contra-rotating in engagement with the downstream side corrugating roll 9, numeral 11 designates a core paper, numeral 15 designates an endless belt pressing touchingly the downstream side corrugating roll 9, numeral 13 designates a single faced corrugated board sheet, numeral 14 designates a liner, thus a glue application apparatus of a belt pressing type single facer is constructed by the glue application roll 1, the doctor roll 3 and the glue tank 4.

Numeral 5 designates a motor (a rotative drive means for the glue application roll) mounted on the glue application portion unit 7 and the rotation of the motor 5 is transmitted to the glue application roll 1 by a power transmitting means, such as a chain, etc. so that the glue application roll 1 is rotated. Numeral 6a designates a detection device of a circumferential velocity $v_1$ of the glue application roll 1.

Numeral 16 designates a frame, numeral 8 designates a moving device of the glue application portion unit 7 mounted on the frame 16, and the glue application portion unit 7 is moved to the right or left in the figure by the moving device 8 so that the glue application roll 1 makes contact to or separation from the downstream side corrugating roll 9. Numeral 10 designates a control device to control work of the moving device 8 based on detected signals from the detection device 6a of the circumferential velocity $v_1$ of the glue application roll 1 and the detection device 6b of the circumferential velocity $v_2$ of the downstream side corrugating roll 9.

Next is a concrete description on operation of the single facer glue application adjusting apparatus shown in FIG. 1. The downstream side corrugating roll 9 and the upstream side corrugating roll 12 to corrugate the core paper 11 are rotated with a certain revolution corresponding to a production velocity of the single faced corrugated board sheet 13 and the circumferential velocity of the downstream side corrugating roll 9 is set at an ideal circumferential velocity $v_2$ according to specification of the core paper 11 or condition of the glue 2.

On the other hand, the circumferential velocity $v_1$ of the glue application roll 1 is set at a certain ratio to the circumferential velocity $v_2$ of the downstream side corrugating roll 9, for example, at a relative velocity 95% ($v_1$=0.95 $v_2$) or 102% ($v_1$=1.02 $v_2$).

In this state, the moving device 8 is driven by the control device 10, the glue application portion unit 7 is moved to the right to touch the downstream side corrugating roll 9 via the core paper 11, then the circumferential velocity $v_1$ of the glue application roll 1 varies so as to approach the circumferential velocity $v_2$ of the downstream side corrugating roll 9.

At this time, the moving device 8 is stopped by the control device 10 and the glue application portion unit 7 (the glue application roll 1) is fixed.

By the above operation, a gap between the glue application roll 1 and the downstream side corrugating roll 9 is adjusted to an ideal gap corresponding to a thickness of the core paper 11 and is maintained constant.

The circumferential velocity $v_1$ of the glue application roll 1 is detected by the detection device 6a and the circumferential velocity $v_2$ of the downstream side corrugating roll 9 is detected by the detection device 6b, a detected signal from each of the detection devices 6a, 6b is sent to the control device 10 and a control signal given thereby is sent to the moving device 8 so that movement of the glue application portion unit 7 (the glue application roll 1) is controlled.

According to the preferred embodiment so constructed, such an excellent effect can be obtained that, by a simple operation to position the glue application roll 1 to the downstream side corrugating roll 9 upon variation in the circumferential velocity $v_1$ of the glue application roll 1 during operation, an appropriate glue application gap can be obtained and further that, even in a case of change of orders in process of production, a quick countermeasure can be taken.

Incidentally, while in the above preferred embodiment, movement of the glue application roll 1 is stopped when the circumferential velocity of the glue application roll 1 varies, if movement of the glue application roll 1 is stopped when the circumferential velocity $v_1$ of the glue application roll 1 coincides with the circumferential velocity $v_2$ of the downstream side corrugating roll 9, a further appropriate gap adjustment can be done. Further, if there is a delay in a detection signal from each of the detection devices 6a, 6b or a delay in a signal processing, the glue application roll 1 is retreated after the circumferential velocity $v_1$ of the glue application roll 1 coincides with the circumferential velocity $v_2$ of the downstream side corrugating roll 9, and at the time when the glue application roll 1 comes to rotate at an initially determined circumferential velocity $v_1$, movement of the glue application roll 1 is stopped, thereby an appropriate gap adjustment can be done.

That is, while an ideal state is a state that the gap between the downstream side corrugating roll 9 and the glue application roll 1 equals the thickness of the core paper 11 which is being processed, as a state that the circumferential velocity of the glue application roll 1 coincides exactly with that of the downstream side corrugating roll 9 is a state that the gap is slightly narrower than said ideal gap and that a touching face pressure is excessive, there is a disadvantage that the surface of the glue application roll 1 is worn by frictional resistance with the core paper 11, thus a process to retreat the glue application roll 1 slightly becomes necessary. Such adjustment is taken place with a certain time interval or at each time of change of orders.

Further, in the above preferred embodiment, the circumferential velocity $v_2$ of the downstream side corrugating roll 9 is a comparison velocity, but a circumferential velocity of the upstream side corrugating roll 12 or a running velocity of the core paper 11 can be naturally a comparison velocity.

In the single facer glue application adjusting method and apparatus according to the present invention as mentioned above, the glue application roll which is in a state of rotating at a circumferential velocity different from that of the downstream side corrugating roll is moved to touch the downstream side corrugating roll via a core paper, variation in the circumferential velocity of each said roll caused thereby is detected and a setting position of the glue application roll is adjusted based thereon, thus the gap between the glue application roll and the downstream side corrugating roll can be maintained approximately at the thickness of the core paper, and even in a case of change of thickness of the core paper accompanying with change of orders, a gap adjustment by manual operation can be made unnecessary and occurrence of defective sheet accompanying with operation mistake like negligence of setting change etc. can be prevented.

Further, even in a case of change of thickness of core paper in process of production, the gap between the glue application roll and the downstream side corrugating roll can be automatically adjusted and yet such troublesome operation to correct a gap variation between the glue application roll and the downstream side corrugating roll due to thermal expansion of a main frame, a glue application frame, etc. of a single facer is made unnecessary, glue transfer from the glue application roll to the downstream side corrugating roll can be done always ideally and appearance of produced corrugated board sheet can be improved as well as quality of strength etc. can be enhanced.

And yet such device as a gap sensor etc. is not necessary, construction can be simplified and manufacturing cost of a glue application adjusting apparatus can be decreased.

While a principle of the present invention has been described above in connection with preferred embodiments of the invention, it is intended that all matter contained in the above description and illustrated in the accompanying drawings shall be interpreted to be illustrative and not in a limiting sense.

What is claimed is:

1. A single facer glue application adjusting method for adjusting a position of a glue application roll to a downstream side corrugating roll which corrugates a core paper in engagement with an upstream side corrugating roll, comprising the steps of:

rotating said glue application roll at a circumferential velocity different from a circumferential velocity of said downstream side corrugating roll;

moving said glue application roll toward said downstream side corrugating roll to touch said downstream side corrugating roll via the core paper; and when the circumferential velocity of said glue application roll varies, stopping movement of said glue application roll so that a gap between said glue application roll and said downstream side corrugating roll is adjusted approximately to a thickness of the core paper.

2. The method of claim 1, wherein said step of rotating said glue application roll at a circumferential velocity different from a circumferential velocity of said downstream side corrugating roll includes rotating said glue application roll with a first rotative drive means and rotating said downstream side corrugating roll with a second rotative drive means; said step of moving said glue application includes using a moving device to move said glue application roll; and said step of stopping movement includes using a control device to a) compare velocities detected by a first velocity detection device for detecting a velocity of said glue application role and a second detection device for detecting a velocity corresponding to said downstream side corrugating roll and to b) cause said moving device to stop movement.

3. A single facer glue application adjusting method for adjusting a position of a glue application roll to a downstream side corrugating roll which corrugates a core paper in engagement with an upstream side corrugating roll, comprising the steps of:

rotating said glue application roll at a circumferential velocity different from a circumferential velocity of said downstream side corrugating roll;

moving said glue application roll toward said downstream side corrugating roll to touch said downstream side corrugating roll via the core paper; and when the circumferential velocity of said glue application roll coincides with the circumferential velocity of said downstream side corrugating roll, stopping movement of said glue application roll so that a gap between said glue application roll and said downstream side corrugating roll is adjusted approximately to a thickness of the core paper.

4. The method of claim 3, wherein said step of rotating said glue application roll at a circumferential velocity different from a circumferential velocity of said downstream side corrugating roll includes rotating said glue application roll with a first rotative drive means and rotating said downstream side corrugating roll with a second rotative drive means; said step of moving said glue application includes using a moving device to move said glue application roll; and said step of stopping movement includes using a control device to a) compare velocities detected by a first velocity detection device for detecting a velocity of said glue application role and a second detection device for detecting a velocity corresponding to said downstream side corrugating roll and to b) cause said moving device to stop movement.

5. A single facer glue application adjusting method for adjusting a position of a glue application roll to a downstream side corrugating roll which corrugates a core paper in engagement with an upstream side corrugating roll, comprising the steps of:

rotating said glue application roll at a circumferential velocity different from a circumferential velocity of said downstream side corrugating roll;

moving said glue application roll toward said downstream side corrugating roll to touch said downstream side corrugating roll via the core paper;

after the circumferential velocity of said glue application roll coincides with the circumferential velocity of said downstream side corrugating roll, moving said glue application roll to the direction of separation from said downstream side corrugating roll; and when the circumferential velocity of said glue application roll comes to an initially determined velocity, stopping movement of said glue application roll so that a gap between said glue application roll and said downstream side corrugating roll is adjusted approximately to a thickness of the core paper.

6. The method of claim 5, wherein said step of rotating said glue application roll at a circumferential velocity different from a circumferential velocity of said downstream side corrugating roll includes rotating said glue application roll with a first rotative drive means and rotating said downstream side corrugating roll with a second rotative drive means; said step of moving said glue application includes using a moving device to move said glue application roll; and said step of stopping movement includes using a control device to a) compare velocities detected by a first velocity detection device for detecting a velocity of said glue application role and a second detection device for detecting a velocity corresponding to said downstream side corrugating roll and to b) cause said moving device to stop movement.

7. A single facer glue application adjusting apparatus for adjusting a position of a glue application roll to a downstream side corrugating roll which corrugates a core paper in engagement with an upstream side corrugating roll, comprising a moving device to move said glue application roll touchably to and separably from said downstream side corrugating roll, a detection device to detect a circumferential velocity of said glue application roll, a detection device to detect a circumferential velocity of said downstream side corrugating roll and a control device to receive signals from said both detection devices and to control work of said moving device, and being so constructed that a gap between said glue application roll and said downstream side corrugating roll is adjusted approximately to a thickness of the core paper upon variation in the circumferential velocity of said glue application roll.

* * * * *